US008763931B2

(12) United States Patent
Zhou

(10) Patent No.: US 8,763,931 B2
(45) Date of Patent: Jul. 1, 2014

(54) AWNING MIST SYSTEM

(76) Inventor: Wei Zhou, Granger, IN (US)

( * ) Notice: Subject to any disclaimer, the term of this patent is extended or adjusted under 35 U.S.C. 154(b) by 264 days.

(21) Appl. No.: 13/288,460

(22) Filed: Nov. 3, 2011

(65) Prior Publication Data

US 2013/0112774 A1 May 9, 2013

(51) Int. Cl.

| | |
|---|---|
| ***B05B 15/00*** | (2006.01) |
| ***B05B 1/14*** | (2006.01) |
| ***E04F 10/00*** | (2006.01) |
| ***E04F 10/06*** | (2006.01) |

(52) U.S. Cl.

USPC ..... 239/289; 239/550; 239/566; 160/45; 160/127

(58) Field of Classification Search

USPC ..... 239/16–19, 24, 207–209, 266–268, 239/279–281, 289, 547, 548, 550, 566, 589, 239/600, 726; 160/22, 23.1, 45, 127

See application file for complete search history.

(56) References Cited

U.S. PATENT DOCUMENTS

| | | | | |
|---|---|---|---|---|
| 2,551,538 | A * | 5/1951 | Hensel | 239/424 |
| 5,330,104 | A * | 7/1994 | Marcus | 239/266 |
| 5,441,202 | A * | 8/1995 | Wintering et al. | 239/267 |
| 5,934,349 | A * | 8/1999 | Faller | 160/127 |
| 6,081,944 | A * | 7/2000 | Edwards | 4/496 |
| 2004/0188544 | A1 * | 9/2004 | Pavlik | 239/289 |
| 2005/0077391 | A1 * | 4/2005 | Powell et al. | 239/373 |
| 2006/0060676 | A1 * | 3/2006 | Wintering et al. | 239/548 |
| 2008/0011878 | A1 * | 1/2008 | Maples | 239/281 |
| 2008/0128095 | A1 * | 6/2008 | Van Zutven | 160/22 |
| 2008/0314306 | A1 * | 12/2008 | Santa Cruz et al. | 114/343 |
| 2010/0206961 | A1 * | 8/2010 | Turner | 239/207 |

* cited by examiner

*Primary Examiner* — Darren W Gorman

(74) *Attorney, Agent, or Firm* — Botkin & Hall, LLP; Michael D. Marston

(57) ABSTRACT

A mist system having an outer wall and an inner channel. The inner channel allows fluid communication between an inlet and an outlet. The outlet includes a nozzle for providing a mist spray. The mist system incorporates a covering, such as for an awning or bimini cover.

8 Claims, 8 Drawing Sheets

AWNING MIST SYSTEM

BACKGROUND OF THE INVENTION

Awning systems are used to provide shade during recreation and other activities. Awning systems may take many forms, and are generally constructed from fabric draped or stretched between opposing supports. Such awnings may take the form of tents, umbrellas, or other similar structures. Awnings are effective in blocking the sun, but additional relief may be desired on hot days.

Mist systems are generally constructed from flexible tubing, such as rubberized hoses, having nozzles periodically spaced along the tubing. A water source is connected to the tubing such that a fine mist is emitted from the nozzles. Mist systems are generally deployed such that they provide a fine mist of water to the surrounding area. A person contacted by the mist of water will feel a cooling sensation as the water evaporates from the skin and removes heat therefrom in the process.

Mist systems are built as discrete systems which must be incorporated onto some type of structure. Generally, mist systems are draped over, or fastened to, existing or portable structures. The downside of current mist systems is that they generally must be deployed and removed whenever the structure they are draped over is moved. This can be tedious when being draped over a portable structure, such as an awning.

As such, an improved mist system is needed to overcome these and other failings of the prior art.

SUMMARY OF THE INVENTION

The present disclosure describes a portable shelter having an integral misting apparatus. The misting apparatus is carried within the support members of the shelter. A typical portable shelter includes one or more tubular support members which carry a fabric or other material suitable for blocking the sun. The present disclosure describes an internal fluid housing formed within the tubular support member which carries water between an inlet and one or more outlet. The inlet is in fluid communication with a water source. The outlet includes a nozzle which sprays a fine mist of water.

BRIEF DESCRIPTION OF THE DRAWINGS

A preferred embodiment of this invention has been chosen wherein.

DESCRIPTION OF THE PREFERRED EMBODIMENT

Figure 1:
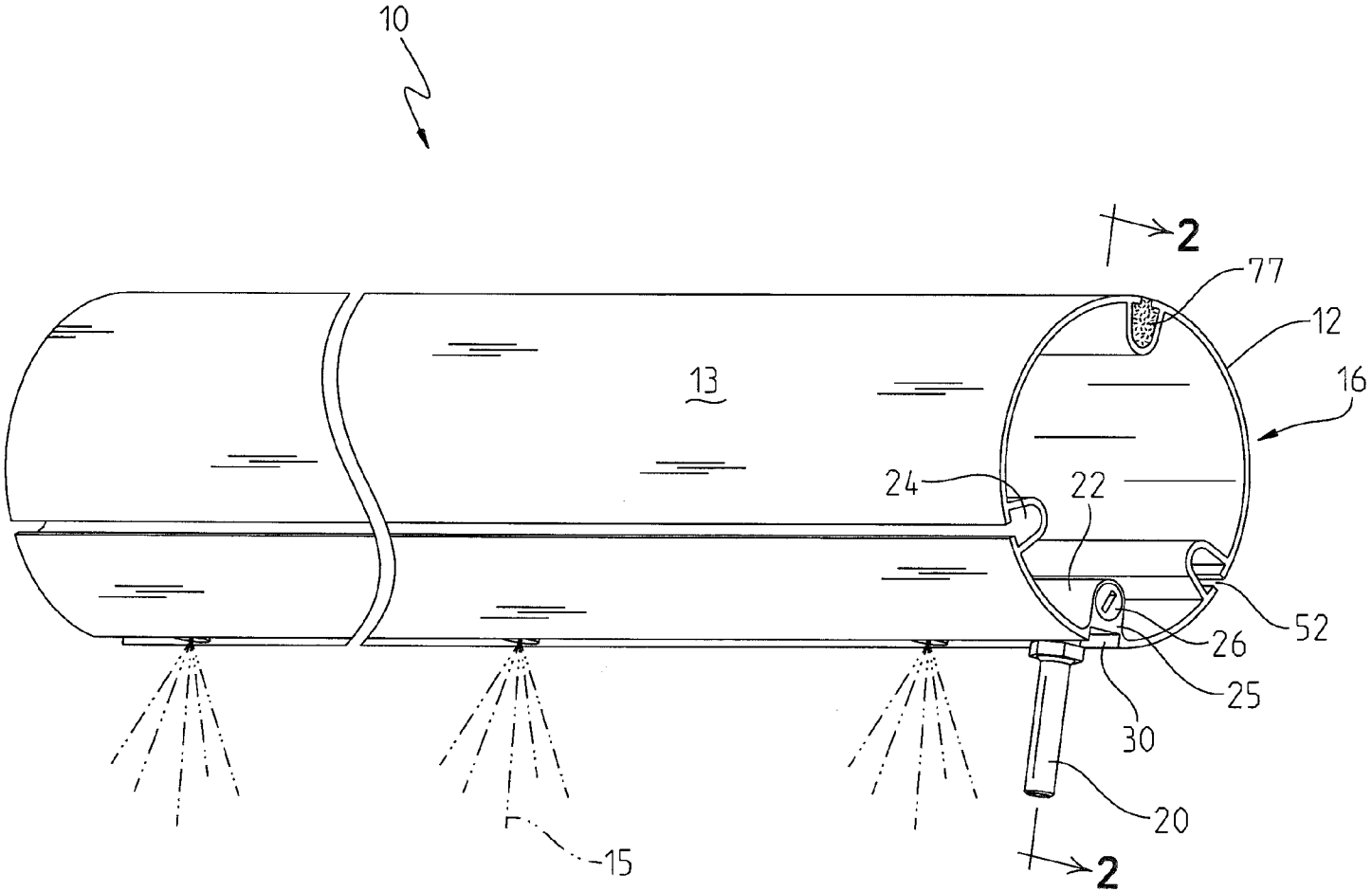
FIG. 1 is a perspective view of the mist system.

The present disclosure describes a mist system 10 having an outer wall 12 and an integral fluid-carrying channel 14.

Mist system 10 delivers a fluid as a mist 15 through nozzle 18. In the preferred embodiment, mist system 10 is a component of a shade-providing assembly such as an awning, bimini cover, tent, or similar assembly wherein housing 12 is part of the support structure of the shade-providing assembly.

Figure 2:
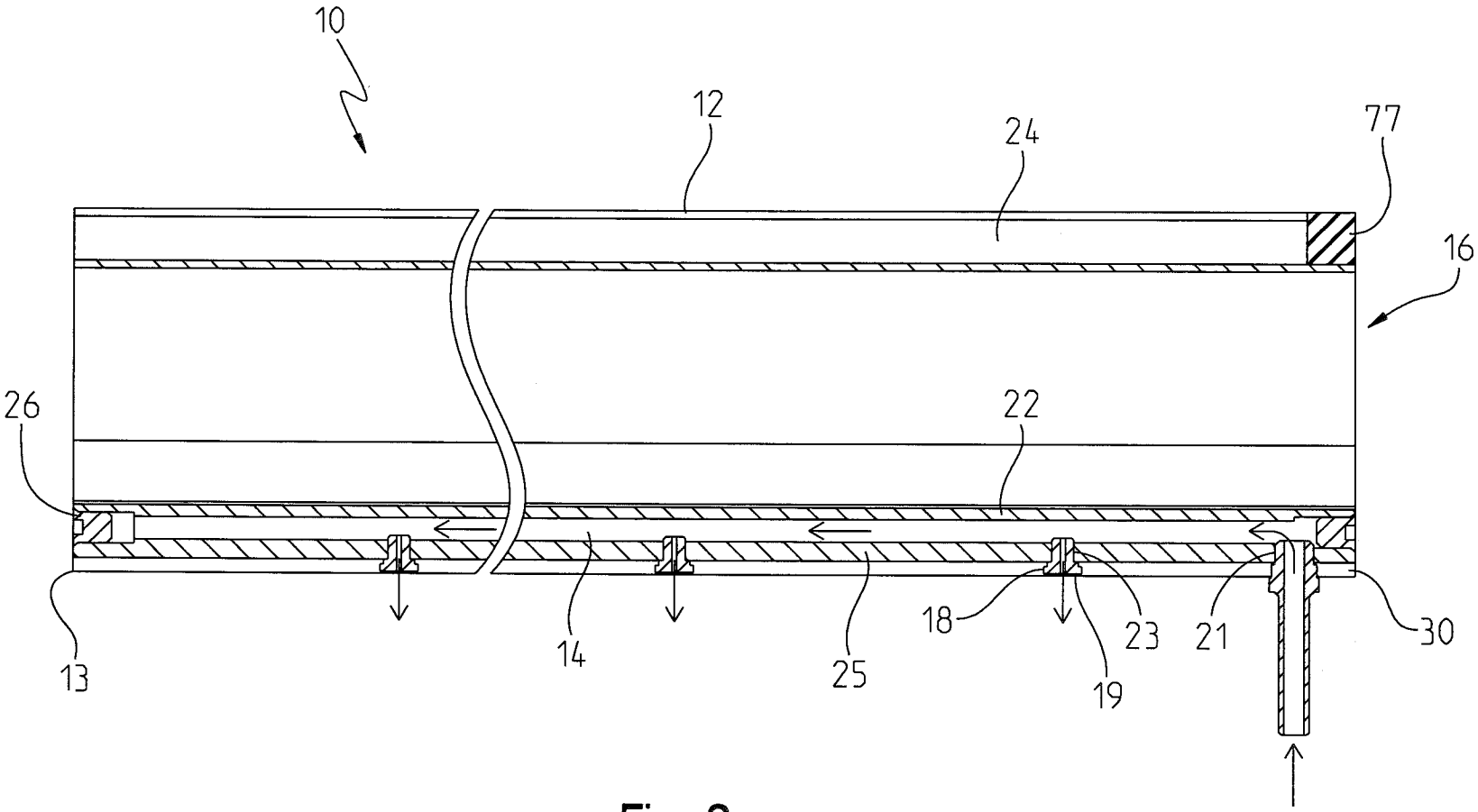
FIG. 2 is a cross-sectional view of the mist system of FIG. 1 as shown cut along the line 2-2.

Referring now to FIGS. 1 and 2, mist system 10 includes a tubular member having an outer wall 12 which encloses an inner chamber 16. Outer wall 12 has an outer surface 13 which defines the outer perimeter of mist system 10. Inner chamber 16 includes a channel 14 which provides fluid communication between one or more nozzles 18 and an inlet 20. Channel 14 is enclosed by a channel wall 22 and a bottom wall 25 which forms a portion of a recess 30. Recess 30 is a longitudinally-extending recess of outer wall 12 which extends inwardly of outer surface 13 to bottom wall 25, as described in greater detail below. Outer wall 12 also optionally includes one or more auxiliary channels 24, as described in greater detail below.

In the preferred embodiment, outer wall 12, auxiliary channel 24 and channel wall 22 are all formed as a single piece of material, such as by extrusion molding or similar forming process. Outer wall 12 is formed from any satisfactory material, such as aluminum or other suitable metal, polymer, ceramic or another suitable composite or synthetic material suitable for carrying a fluid. Outer wall 12, auxiliary channels 24 and channel wall 22 may also be formed as separate elements and joined together by welding or adhesive.

Recess 30 generally extends the longitudinal length of outer wall 12 and extends inwardly from outer surface 13 to bottom wall 25. Bottom wall 25 is spaced inwardly from outer surface 13 a sufficient distance such that nozzle 18 is recessed below the outer surface. Bottom wall 25 of recess 30 is a constituent member of both channel wall 22 and recess 30. A number of apertures are formed through recess 30, including inlet aperture 21 and outlet aperture 23. Such apertures are in fluid communication with channel 14.

Channel 14 is an axially-extending channel suitable for carrying fluid between inlet 20 and one or more nozzles 18. Nozzle 18 includes an aperture which allows fluid to exit channel 14. In the preferred embodiment, nozzle 18 is shaped such that as fluid exits the nozzle, the fluid is sprayed as a mist 15. Nozzle 18 extends axially away from recess 30 and terminates in a nozzle tip 19. In one embodiment nozzle 18 is formed as part of outer wall 12 of mist system 10. In another embodiment, nozzle 18 is seated in an outlet aperture 23 which forms an opening through recess 30 to channel 14. Channel 14 extends all or most of the axial length of outer wall 12 and in one embodiment includes one or more plug 26 at either end of the channel to prevent fluid from escaping from the ends of the channel. In an additional embodiment, multiple segments of mist system 10 are joined end-to-end with the respective channels 14 forming a continuous fluid path therebetween. In the preferred embodiment, inlet 20 is fitted in an inlet aperture 21 adjacent one of plugs 26, though inlet 20 may also be positioned at any position along the length of channel 14.

Figure 3:
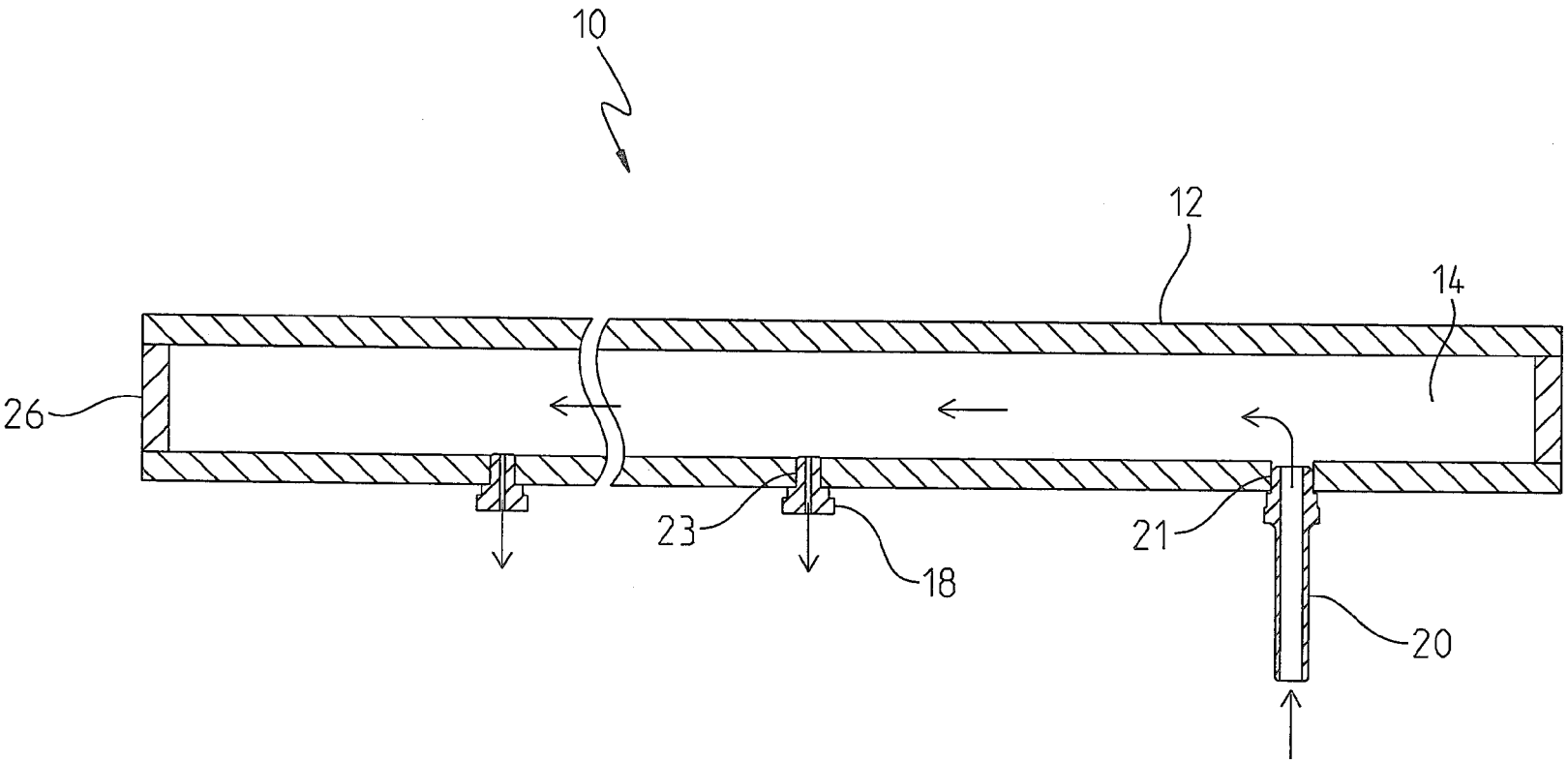
FIG. 3 is a cross-sectional view of an alternative embodiment of the mist system.

An alternative embodiment of mist system 10 is shown in FIG. 3. In this embodiment, outer wall 12 is also the outer wall of channel 14 such that inner chamber 16 and channel 14 fill the same space. At least two apertures 21, 23 are formed in outer wall 12, with at least one aperture accepting an inlet 20 and at least one aperture accepting a nozzle 18. Inlet 20 is in fluid communication with nozzle 18 via channel 14. FIG. 3 shows nozzles 18 extending from outer wall 12 of mist system 10, rather than being seated in a recess. It is understood that the mist system of FIGS. 1 and 2 could omit recess 30 and have nozzles 18 extend from outer wall 12 as shown in FIG.

3 Additionally, the embodiment in FIG. 3 may be modified to include a channel 14 formed within chamber 16 similar to as is described in FIGS. 1 and 2. Further, the embodiment of FIG. 3 may be modified to include a recess 30 for insetting nozzles 18 from outer wall 12, such as to allow an awning to be wrapped around the mist system without the awning contacting the nozzles. Like with all embodiments described herein, it is understood that mist system 10 of FIG. 3 is compatible as used in an awning, a bimini cover, or any other form of shade-providing shelter.

Figure 4:
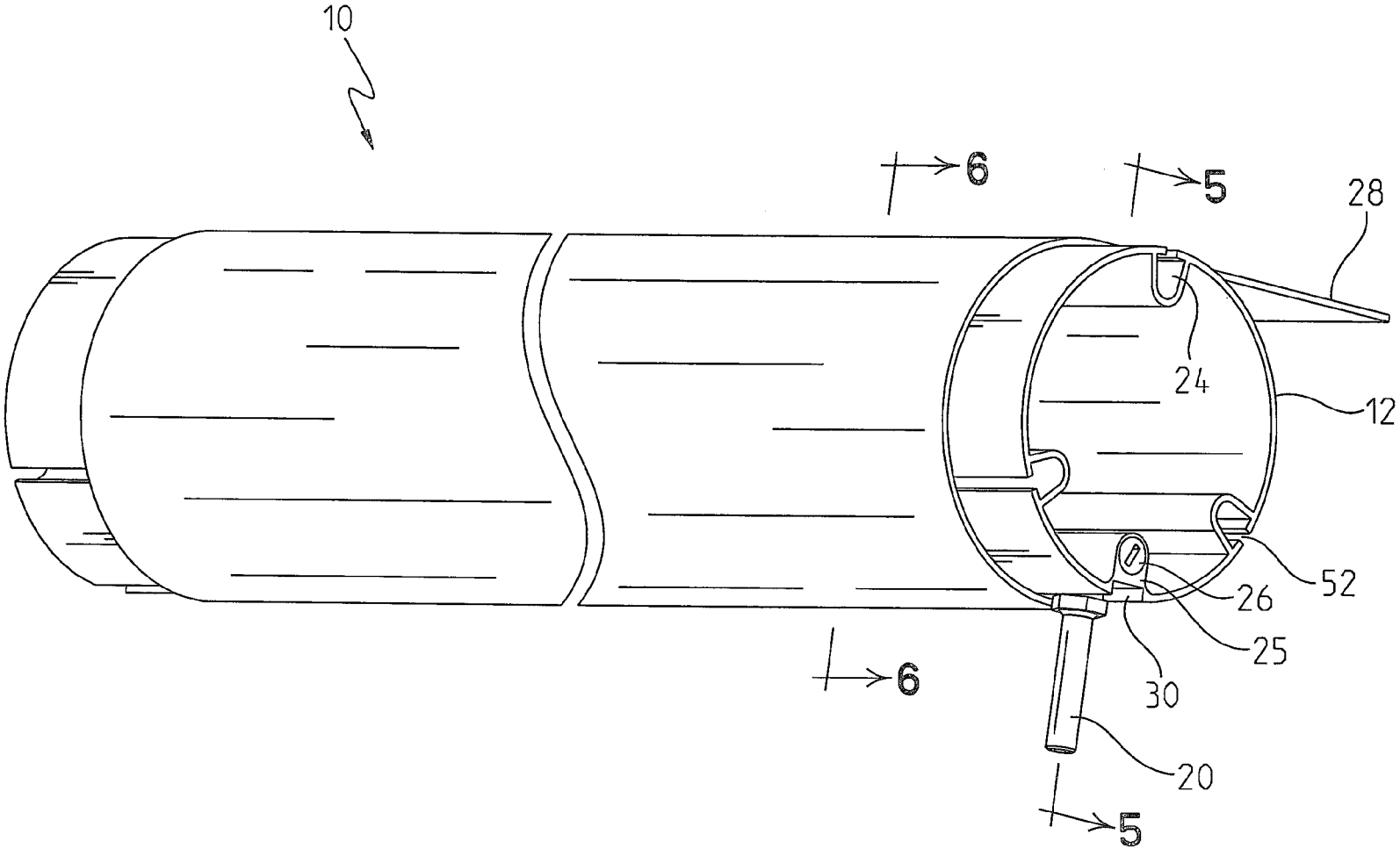
FIG. 4 is a perspective view of the mist system including an awning in a partially-rolled orientation.
Figure 5:
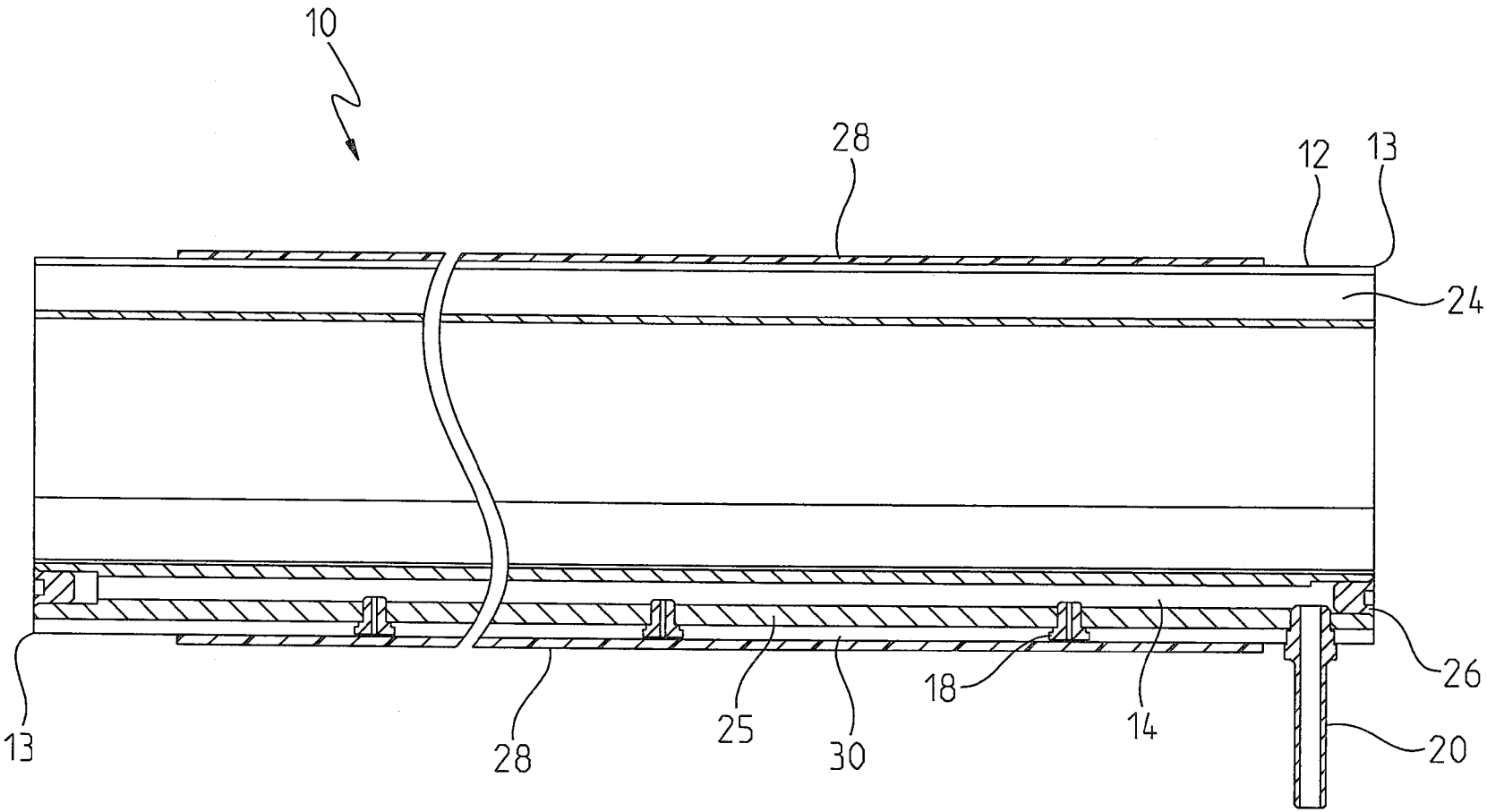
FIG. 5 is a cross-sectional view of the mist system of FIG. 4 as shown cut along with line 5-5.
Figure 6:
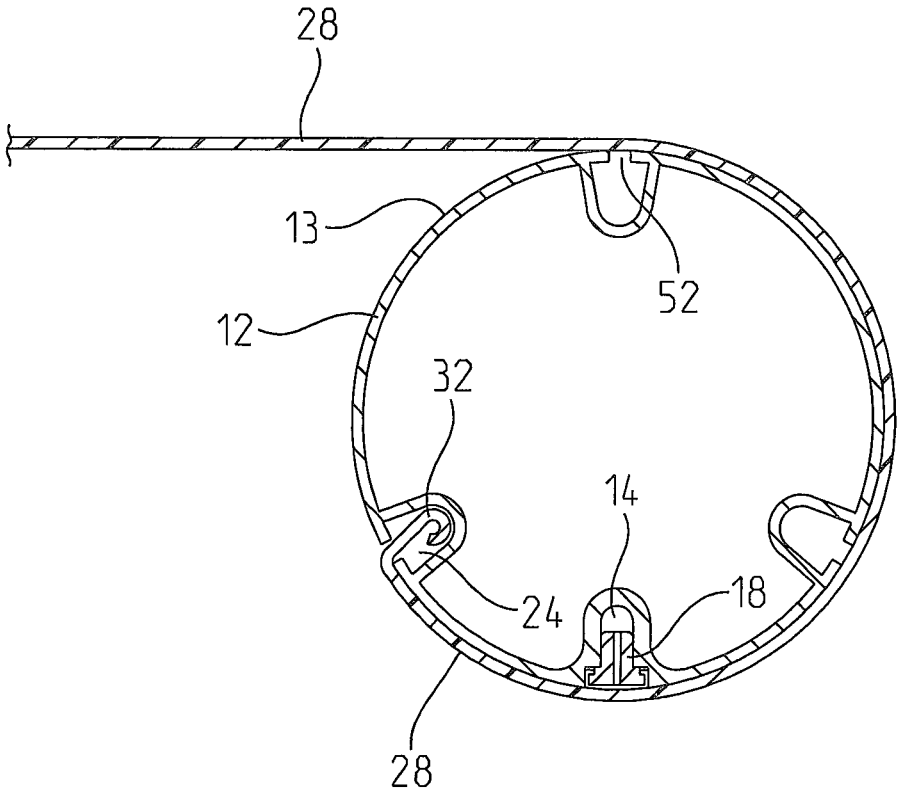
FIG. 6 is a cross-sectional view of the mist system of FIG. 4 as shown cut along the line 6-6.

Mist system 10 preferably serves a dual purpose: to serve as a support for an awning 28, or similar shade-providing apparatus, and to carry and deliver a fluid mist 15. FIGS. 4-6 show mist system 10 carrying awning 28. Awning 28 can be in a wrapped, partially wrapped, or unwrapped position as defined by the degree which the awning is wrapped around outer surface 13 of outer wall 12. FIG. 4 provides a perspective view of awning 28 partially wrapped around the outer surface 13 of outer wall 12. Awning 28 is typically wrapped around outer wall 28 when being stored or transported. When awning 28 is in the wrapped or partially wrapped position, the awning obstructs nozzle 18, as shown in FIG. 4. In the preferred embodiment, outer wall 12 includes a recess 30 extending most or all of the axial length of outer wall 12. As shown in FIG. 5, recess 30 allows nozzle tip 19 to be spaced inwardly from outer surface 13 such that when awning 28 is in the wrapped position, the nozzles will not puncture or otherwise damage the awning material. Recess 30 has a depth sufficient that nozzle tip 19 does not extend beyond the outer surface 13 of outer wall 12.

Auxiliary channel 24 is an inwardly-extending slot formed in outer wall 24, as shown in cross-section in FIG. 6. Slit 52 extends the length of auxiliary channel 24 and forms an opening through outer wall 12 to auxiliary channel 24. Auxiliary channel 24 has a generally U-shaped cross-section and is joined to outer wall 12 at positions flanked radially outward of slit 52. Slit 52 is preferably more narrow than channel 24 such that auxiliary channel 24 is suitable for carrying an anchor 32. Anchor 32 serves to retain awning 28, or other apparatus, to mist system 10. Anchor 32 is removable from auxiliary channel 24. When in the unwrapped position, additional auxiliary channels 24 may be used to mount or hang items from mist system 10. In one embodiment auxiliary channel 24 includes a plug 77 at one or both of the terminal ends of the channel to prevent anchor 32 from sliding axially out of the channel.

Inlet 20 allows fluid communication between an external fluid source and channel 14. As illustrated in FIG. 4, inlet 20 is preferably located adjacent plug 26 at one of the terminal ends of mist system 10 in recess 30. Inlet 20 is preferably seated in inlet aperture 21. By locating inlet 20 near plug 26, when awning 28 is in the wrapped or partially wrapped position, the awning does not contact the inlet since awning 28 does not extend the entire length of outer wall 12. Thereby, awning 28 may be wrapped and unwrapped without having to remove inlet 20 from mist system 10.

Figure 7:
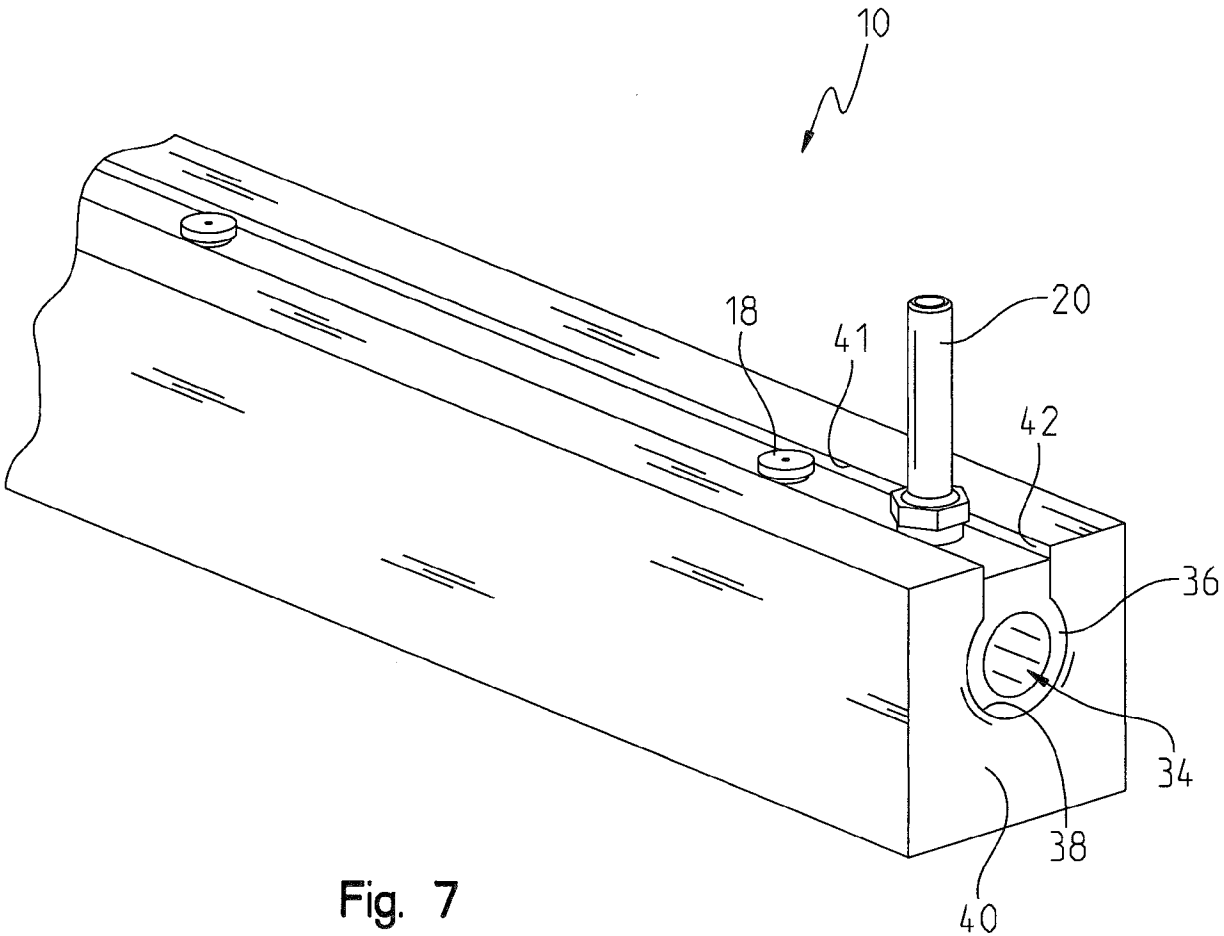
FIG. 7 is a perspective view of an additional embodiment of the mist system.

FIG. 7 shows an alternative embodiment of mist system 10. In this embodiment, channel 34 is formed as the inner portion of a hose 36. Hose 36 is shaped to nest within keyhole channel 38. Keyhole channel 38 is formed as an axially-extending channel in housing 40 having a generally circular portion and a notch extending therefrom, together forming a keyhole shape. In one version of this embodiment, housing 40 is formed from a solid material as shown in FIG. 7. in another version of this embodiment, housing 40 has a hollow inner chamber similar to what is shown in FIGS. 1-6 surrounding keyhole channel 38. In either version, hose 36 fills keyhole channel 38 and extends short of the outer edge 41 of housing 40 such that a recess 42 is formed proximate the hose. Hose 36 includes at least two apertures (not shown), one for accepting one or more nozzles 18 and one for accepting inlet 20. The embodiment in FIG. 7 could be readily modified to include one or more auxiliary channels 24 similar to those shown in FIG. 6 for carrying an awning or other apparatus. Additionally, hose 36 either includes a closed end (not shown), or a plug (not shown) at the terminal ends.

Figure 8:
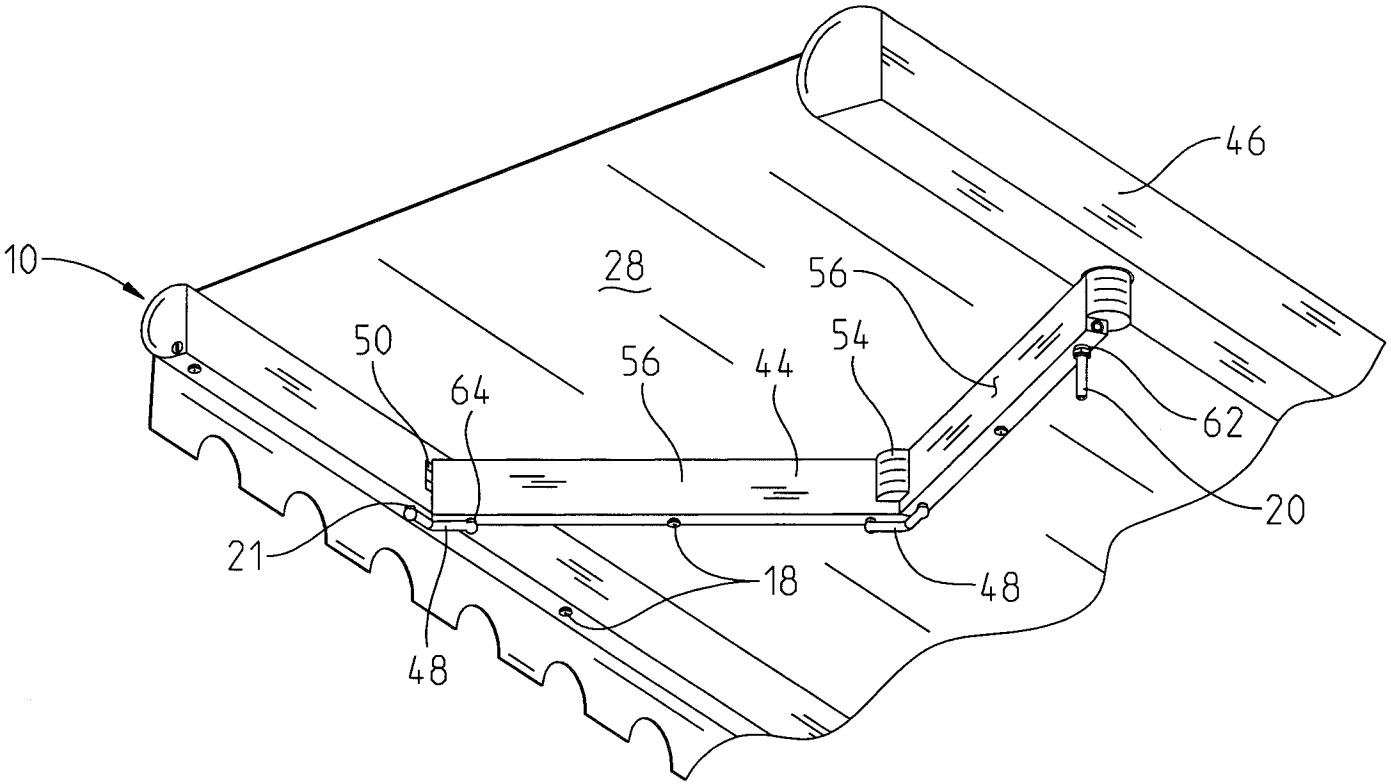
FIG. 8 is a perspective view of the mist system as carried on a support arm and mounted to a support.

In one embodiment, mist system 10 includes a support arm 44 and a support 46 as shown in FIG. 8. Support arm 44 carries mist system 10 and is anchored to support 46. Support arm 44 is formed having an outer wall 56 defining an inner chamber. A support arm channel is formed in inner chamber and allows fluid communication between a support arm inlet aperture 62 and a support arm outlet aperture 64. Support arm inlet aperture 62 is in fluid communication with a fluid source. One of support arm outlet apertures 64 carries a nozzle 18. Another of support arm outlet apertures 64 is in fluid communication with inlet aperture 21 by a connecting member such as a bridge hose 48.

Support arm 44 may include a joint 50, 54 about which support arm is foldable to a collapsed position which draws mist system 10 toward support 46. Support 46 is any type of structure suitable for having support arm 44 and mist system 10 mounted thereto. One or more bridge hose 48 serves to provide a fluid path at joints 50, 54 where the internal channel is discontinuous. Internal channel and bridge hose 48 allow for fluid communication between inlet 20 and each of nozzles 18. Support arm 44 is compatible with the mist system embodiments of FIG. 1-6 and FIG. 7. The advantage of support arm 44 is that it allows adjustment of the position of mist system 10 relative support 46 and also allows fluid to be moved between each of nozzles 18. By including internal fluid-carrying channels within both mist system 10 and support arm 44, mist 15 is deployable under a greater portion of the area under awning 28.

The invention is not limited to the details given above, but may be modified within the scope of the following claims.

What is claimed is:

1. A mist system comprising:

a tubular member having an outer wall defining an inner chamber, said outer wall having an outer surface;

an internal channel integrally formed within said tubular member and defined by a channel wall and a bottom wall, said bottom wall being spaced inwardly of said outer surface of said outer wall, said internal channel being spaced inwardly from said bottom wall;

a longitudinal recess within said outer wall having an innermost portion defined by said bottom wall;

an inlet aperture providing fluid communication between a fluid source and said internal channel;

an outlet aperture formed through said bottom wall, said internal channel allowing fluid communication between said inlet aperture and said outlet aperture;

said outlet aperture containing a nozzle having a tip defining an end most portion of said nozzle, said nozzle extending outwardly of said bottom wall, said tip not extending beyond said outer surface of said outer wall; and an auxiliary channel extending inwardly of said outer surface said auxiliary channel having a width, said auxiliary channel including a slit through said outer surface said slit being narrower than said width of said auxiliary channel.

2. The mist system of claim 1, including an anchor retained in said auxiliary channel, said anchor being wider than said slit, an awning being affixed to said anchor.

3. The mist system of claim 2, wherein said anchor is axially slideable within said auxiliary channel.

4. The mist system of claim 3, wherein said tubular member includes a plurality of auxiliary channels.

5. The mist system of claim 4, wherein said tubular member is round in cross section, and said auxiliary channels being evenly spaced around said tubular member.

6. The mist system of claim 3, wherein said auxiliary channel includes a plug to prevent said anchor from sliding axially out of said channel.

7. The mist system of claim 1, wherein said longitudinal recess extends the entire length of said tubular member.

8. The mist system of claim 7, wherein said internal channel extends the entire length of said tubular member and is capped with a plug.

* * * * *